US006654959B1

(12) United States Patent
Alpert

(10) Patent No.: US 6,654,959 B1
(45) Date of Patent: Dec. 2, 2003

(54) GLOVE WITH ENHANCED RETENTION CAPABILITIES

(76) Inventor: Martin A. Alpert, 26061 Annesley, Beachwood, OH (US) 44122

( * ) Notice: Subject to any disclaimer, the term of this patent is extended or adjusted under 35 U.S.C. 154(b) by 0 days.

(21) Appl. No.: 10/023,549

(22) Filed: Dec. 17, 2001

(51) Int. Cl.[7] ..... A41D 13/08
(52) U.S. Cl. ..... 2/19
(58) Field of Search ..... 2/19, 16, 158, 2/159, 161.1, 161.2, 161.3, 161.6, 161.8, 169

(56) References Cited

U.S. PATENT DOCUMENTS 1,056,909 A * 3/1913 King ..... 2/19
4,339,830 A * 7/1982 Sasaki ..... 2/19
4,691,387 A * 9/1987 Lopez ..... 2/159
5,022,094 A * 6/1991 Hames et al. ..... 2/163
5,117,509 A * 6/1992 Bowers ..... 2/161.1
5,398,342 A * 3/1995 Kinnee et al. ..... 2/161.1
5,708,979 A * 1/1998 Redwood et al. ..... 2/161.1
5,815,839 A * 10/1998 Safford ..... 2/161.1
6,209,138 B1 * 4/2001 Kang ..... 2/167
6,305,022 B1 * 10/2001 Oomura et al. ..... 2/19
6,370,691 B2 * 4/2002 Park ..... 2/19

* cited by examiner

*Primary Examiner*—Gary L. Welch
(74) *Attorney, Agent, or Firm*—Renner, Otto, Boisselle & Sklar, LLP

(57) ABSTRACT

A leather baseball glove that complies with the code of rules for baseball has a front face of two suede leather material portions, each having a nap with a smooth direction and a resistant direction, the smooth directions facing each other tending to facilitate movement of a ball into the glove pocket and tending to impede movement of a ball away from the pocket and/or out of the glove to enhance ball retaining characteristics of the glove. A method of making a glove includes attaching plural glove portions, at least one of which has a nap with a smooth and braking directions, and orienting such nap to provide preferred smooth and braking directions to enhance ball retention. Use of nap characteristics to enhance holding the shaft of an implement or other device. A method of retrofitting a device for enhanced retention characteristics.

7 Claims, 3 Drawing Sheets

GLOVE WITH ENHANCED RETENTION CAPABILITIES

TECHNICAL FIELD

This invention relates generally to enhancing the gripping ability of gloves worn on the human hand for a variety of applications, such as participation in sporting events, and industrial purposes and/or other purposes, and, more particularly, to a baseball glove that meets baseball rules and has enhanced ball catching, gripping and/or retention capability.

BACKGROUND

Glove technology needs to meet the needs of society today. With evergrowing environmental concerns there exists a need in society to produce products which are both environmentally friendly and aid people in carrying out their everyday activities. Participating in sports is one such activity. Gloves are used in a variety of sports both to protect the user's hands and to aid in gripping ability. The current state of grip enhancing technology for gloves includes use of coating materials or silicon coated materials. Coating materials may include silicon based treatments or other chemical treatments.

Gloves are particularly useful in the game of American baseball; in fact, it would be virtually impossible to play the game without the use of a baseball glove (sometimes referred to as a mitt). The "code of rules" govern the playing of baseball games by professional teams of the American League of Professional Baseball Clubs, the National League of Professional Baseball Clubs, and the leagues which are members of the National Association of Professional Baseball Leagues. Rules 1.11, 1.12 and 1.13 concern baseball gloves or mitts. These rules require that baseball glove be made of leather.

Even with the use of a baseball glove, often it is very difficult for the participants to catch the ball in the glove, whether they are professionals, children or weekend warriors.

Various shapes have been used for baseball gloves for use catching a ball and retaining a caught ball. Some gloves have long extensions, e.g., long fingers or finger portions (including a thumb portion), but the longer the fingers, the greater the tendency of a glove to become too flexible and to lose gripping force transmitted from a player's fingers and thumb to the remote portion of the glove finger portion. Such flexibility and, to an extent, non-responsiveness immediately to the player's finger action may lead to a ball falling, sliding or bouncing out of a glove, leading to a "dropped ball" rather than to a "catch."

Baseball gloves currently are made of leather, as the rules require. Usually the smooth side of the leather is exposed as the outside surface of the glove, both on the "pocket" (sometimes referred to as the glove's "sweet spot") or front side and on the back outside of the glove. The rougher surface or if a double layer is used, the smooth surface of the glove faces inside, e.g., where the player's palm, fingers and thumb go. The glove also may include an interior lining and/or padding or shock absorbing material. However, due to the relatively smooth outside surface at the pocket and/or at the fingers generally facing and/or leading to the pocket, a ball may have a tendency to slide out of the glove as a player is attempting to catch a ball and/or to retain a ball in the glove.

Thus, there is a need to improve the ball catching and ball retaining functions of baseball gloves and of other gloves. Examples of other gloves that would benefit from enhanced gripping features are hockey, tennis, golf, and vehicle driving gloves and those used by workers to grip parts, e.g, small parts such as nuts, screws and the like.

Suede is a leather material. Suede usually has a nap with a characteristic smooth direction and a rough or resistant direction (sometimes referred to as the "braking direction"). An object moving, e.g., sliding or rolling, along suede in the smooth direction usually can slide or roll relatively easily. However, an object moving along, e.g., trying to slide or to roll, in the rough or relatively resistant direction will not move as easily as in the smooth direction.

Glove manufacturers have tried to facilitate catching and retaining a ball in a baseball glove by providing their gloves with different coatings on the leather to help keep the ball in the glove after it's been caught. The use of such coatings is disadvantageous to the environment. Also, chemical coatings may cause users an allergic reaction.

BRIEF SUMMARY OF THE INVENTION

With the above in mind, an aspect of the invention relates to a sports glove including leather material having several portions respectively secured to form an interior for one or more digits (thumb and/or fingers) of a user, at least one of the leather material portions having a grain or nap on an exterior surface, the nap having a relatively smooth direction and a relatively braking direction, and the at least one portion oriented with the resistant or braking direction to resist movement of a ball out of the glove.

Another aspect relates to a sports glove including leather material including several portions respectively secured to form an interior for one or more digits of a user, at least one of the leather material portions having a nap on an exterior surface, the nap having a relatively smooth direction and a relatively resistant to sliding direction, and the at least one portion oriented with the resistant direction to resist relative movement between an object and the glove.

Another aspect relates to a glove for use on the hand of a person, including a material having a grain or nap favoring smooth movement along the nap in one direction and tending to resist or to oppose movement in a different direction, the material patterned in a shape to include an interior space for at least part of a hand used to manipulate the glove, and the material having an exterior, the nap being at the exterior and oriented to enhance gripping.

Another aspect relates to a baseball glove, including a finger portion and a pocket, the finger portion having a nap with a smooth direction leading toward the pocket and a rough direction resisting sliding movement away from the pocket.

Another aspect relates to a method of making a glove including attaching together a number of glove portions, at least one of which has a nap with a smooth direction and a braking direction, and orienting such nap as to provide a preferred smooth direction and a preferred braking direction that tends to resist sliding, rolling or other movement with respect thereto compared to the smooth direction.

Another aspect of the invention relates to a glove including a front, a back, a finger section, a thumb portion, a ball pocket, an opening for the hand, a suede leather material with nap in a first direction, a suede leather material with nap in a second direction, a web portion between the thumb and the finger section, a shock absorbing material, a palm portion, an inside stitch line, a middle stitch line, a top stitch line, a top ball pocket stitch line, a hand opening stitch line and an inside front surface. The suede leather material covers a majority of the front of the glove. The suede materials each have a nap facing in a generally uniform direction. The two suede leather materials are oriented on the front surface of the glove such that the direction of the naps of each leather material face each other.

According to another aspect, a glove also includes a smooth leather ball pocket section on the front surface of the glove, in addition to a finger portion at least part of which is of suede material or the like that has a smooth direction toward the pocket.

Another aspect relates to a shaft for an implement and a material on a portion of the shaft, the material having a nap, the nap having a smooth direction and an opposite direction, and wherein the nap directions are coordinated with respect to the axis of the shaft to enhance retention of the shaft during use of the implement.

Another aspect relates to a combination of a shaft for an implement and a glove, the shaft having a material on a portion thereof, the material having a nap, the nap having a smooth direction and an opposite direction, the glove including a material having a nap that has a smooth direction and an opposite direction, and wherein the respective opposite directions being coordinated to enhance retention of the shaft by use of the glove.

One or more of the above and other aspects, objects, features and advantages of the present invention are accomplished using the invention described and claimed below.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed.

Although the invention is shown and described with respect to certain embodiments, it is obvious that equivalents and modifications will occur to others skilled in the art upon the reading and understanding of the specification. The present invention includes all such equivalents and modifications, and is limited only by the scope of the claims.

DESCRIPTION

Figure 1:
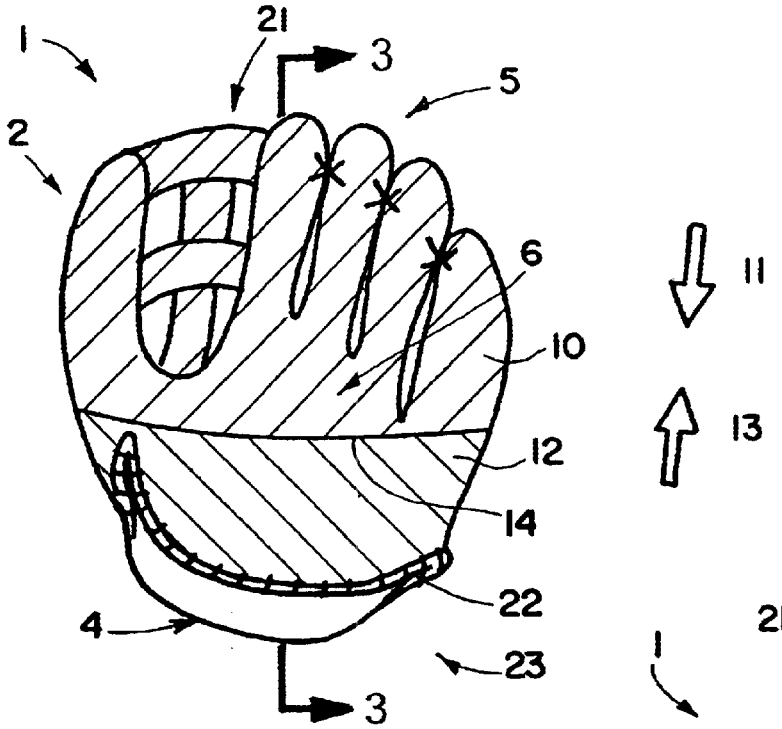
FIG. 1 is a front view of a glove in accordance with the invention.

In the following detailed description, identical components have been given the same reference numerals in several figures.

Figure 2:
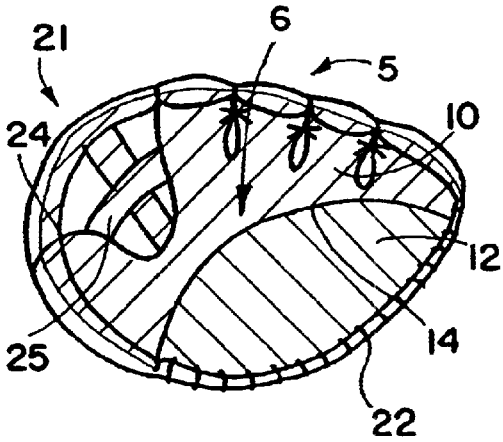
FIG. 2 is a top view of the glove of FIG. 1.
Figure 3:
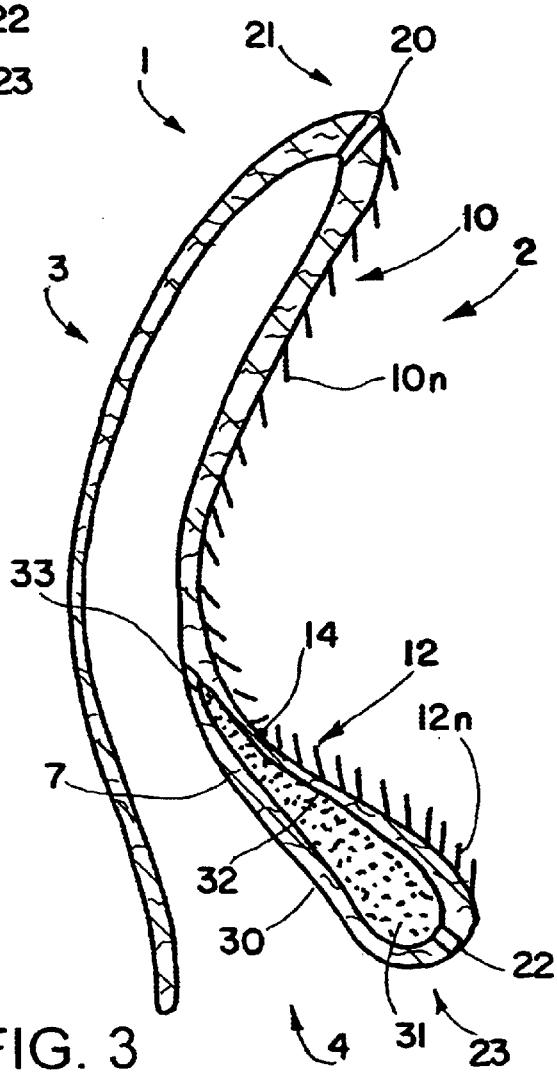
FIG. 3 is a section view of the glove taken along the line 3—3 as indicated in FIG. 1.

Referring to FIGS. 1 through 3, a glove 1 according to the present invention is shown. The illustrated glove 1 has a front 2, a back 3, and an opening 4 for the hand (hand opening). For use in a baseball game to meet the requirements of the code of rules, the glove is made of leather material. It should be noted that another material suitable for use in a glove can be used under other circumstances, e.g., if the glove is to be used for industrial purposes, for driving, or for some purpose other than baseball. The glove 1 has a finger portion 5 for the thumb and one or more other fingers, a pocket 6, and a base or palm portion 7.

The front 2 of the glove 1 includes two primary sections, namely, a first suede leather material 10 having a nap **10*n* (the nap is seen most clearly in FIG. 3) with a smooth direction generally in a first direction represented by an arrow 11, and a second suede leather material 12 having a nap 12*n* with a smooth direction generally directed in a second direction represented by the arrow 13. The respective naps (represented by the arrows 11, 13) of the materials 10, 12 are oriented so they are facing each other or lead toward each other. This is done to facilitate retention of a ball in the glove 1. To that end, the nap of the first suede leather material 10 in the finger portion 5 is oriented in a generally downward direction, relative to the illustration (although up/down, etc. is used only for convenience of description and need not be the actual direction when a glove is in use). The nap of the second suede leather material 12 in the base or palm portion 7 is oriented in a generally upward direction (relative to the illustration) toward the pocket 6. The suede leather materials 10, 12 are attached by a middle stitch and/or glue 14 as is illustrated in FIG. 1. The middle stitch 14 and other stitching of parts of the glove 1** may be of standard type that is in compliance with the code of rules for acceptable use in baseball; or the stitching may be of some other type if meeting the rules is not a requirement.

In an embodiment the suede leather material is applied to an existing glove, as by gluing, sewing, or by some other fastening mechanism or technique. In this way an existing glove or other device can be retrofitted with suede leather material adhered thereto to obtain the various functions and advantages described herein. As an example, suede leather material with nap properly oriented could be glued to the surface of a conventional baseball glove, thus enhancing features of the baseball glove, as are described herein. Alternatively, the suede leather material may be adhered to the handle of an existing sports device, such as a golf club, tennis racket, etc., and suede leather material with nap facing in the appropriate direction relative to that on the sports device may be adhered to a glove used by an individual.

The front 2 of the glove 1 contains the ball pocket 6 defined as the general area in a generally central part of the glove; the pocket surrounds a portion of the middle stitch line 14. As the first suede leather material 10 has a nap 10*n* which is oriented in a generally downward direction 11, i.e., generally toward the pocket 6, a ball entering the top of the glove at the finger portions moves more easily by sliding or rolling toward the pocket and the nap 10*n* tends to resist movement of the ball along the fingers away from the pocket and even tends to resist the ball "popping out" or bouncing out of the glove. Also, as the ball continues to move in the glove, it will meet the nap 12*n*, which will impede further movement. Similarly, a ball entering the bottom (base or palm 7) of the glove is directed toward the ball pocket 6 by the upward direction 13 of the nap 12*n* of the second suede leather material 12. If a ball enters the glove traveling in a direction with the nap 12*n* of the suede leather material it will experience a lower frictional force or mechanical force than if it were traveling against the direction of the suede leather material. As a result, the ball will slide relatively easily toward the pocket 6 and the resistance of the suede leather material in directions away from the pocket will tend to impede sliding or rolling of the ball out of the pocket and/or out of the glove 1. As is described above, the ball will meet the higher resistance of nap 11*n*, which will impede further movement of the ball. Thus, the retention of the ball in the glove is facilitated and enhanced by orienting the respective naps 10*n*, 12*n* in their respective directions 11, 13 such that they generally face each other.

Use of the glove 1 as a baseball glove or for some other sport in which a ball usually is caught is described above. However, it will be appreciated that the glove 1 may be used for other sports in which a ball is intended to be caught.

The glove 1 also may be used as a driving glove. In such case the direction of the naps 10*n*, 12*n* may be such as to allow secure gripping of a steering wheel, yet, based to some extent on the hand placement and/or directional orientation, intentionally provide easy sliding of the steering wheel as it is returning back from a turn.

Still further, the glove 1 may be used for industrial purposes to enhance gripping of controls on equipment, such as earth moving equipment, cranes or the like. The glove 1 also may be used to facilitate gripping a small object, such as a nut or screw. By having the nap direction similar to that illustrated in FIGS. 1–3 the gripping of controls or of a nut or screw is enhanced. Thus, the likelihood of the glove sliding off a control knob, for example, or of a nut or screw being dropped or released as it is picked up, as another example, is reduced.

It is possible that with use the nap 10*n*, 12*n* may become pressed down against the main surface of the leather, e.g, to make a relatively smooth surface without a nap. In such a case the leather and/or nap can be brushed to regain its nap-like/directional properties.

The front 2 and the back 3 of the glove 1 are attached to each other by a top stitch line 20 at the top 21 and a hand opening stitch line 22 at the opening at the bottom 23. Both the front 2 and the back 3 contain a thumb portion 24, a web portion 25 and the finger portion 5. The thumb portion 24 may be considered part of the finger portion 5. The finger portion 5 (including the thumb portion 24) generally defines the area where the wearer's fingers and thumb will be disposed once the glove 1 is placed for use onto the human hand.

The web portion 25 generally includes portions of the first suede leather material 10 having its smooth direction 11 to guide a ball toward the pocket 6 and to resist sliding (or rolling) of a ball out of the glove. The web portion 25 also attaches the thumb portion 24 and the other part of the finger portion, and is standard in most baseball gloves.

The first suede leather material 10 extends from the top of the thumb portion 24, the web portion 25 and the finger portion 5, down toward the glove pocket 6. The second suede leather material 12 generally extends from the hand opening stitch line 22 toward the pocket 6. In the embodiment of FIGS. 1–3 the respective suede materials 10, 12 extend all the way into the pocket 6 (and are a part of the pocket) and meet at the middle stitch line 14.

The leather material for back 3 may be manmade or natural. It is advantageous to use leather material to facilitate comfort for the wearer of the glove 1. Natural leather may include cowhide, pigskin, or any natural skin as known in the art or as required by established rules of American baseball. The suede leather materials 10, 12 may be any material, manmade or natural, containing a nap which has the ability to run in a generally uniform direction. It is advantageous to use natural leather for the front 2 of the glove 1 to meet requirements of the "code of rules" and because of environmental concerns with manufacturing manmade materials treated with grip-enhancing chemicals.

Referring to FIG. 3, a sectional view of the glove 1 is shown according to section line 3—3 as shown in FIG. 1. FIG. 3 more clearly shows the opposing nap directions 11, 13, that is, the nap direction 11 of the nap 10*n* of the first suede leather material 10 and the nap direction 13 of the nap 12*n* of the second suede leather material 12. FIG. 3 shows the inside front surface 30 which comes into contact with the wearer's palm and fingers when worn on the hand. The inside surface also may be suede with an appropriate nap direction to decrease the sliding of the glove on the hand. In the palm portion 7 may be a cushioning or shock absorbing material 31. The shock absorbing material 31 is situated between the walls of the palm portion 7 and a combination of the wall created by the backs of the first and second suede leather materials 10, 12. The shock absorbing material 31 can be composed of any material, manmade or natural, having cushioning and/or shock absorbing or damping properties, as is known and as may be commonly used in baseball mitts. Such materials may include high density foam and/or rubber, or any material known in the art to have a shock absorbing capacity. The palm portion 7 is attached to the wall 32 created by the first and second suede leather materials 10, 12 by the inside stitch line 33 at the top and the hand opening stitch line 22 at the bottom.

Figure 4:
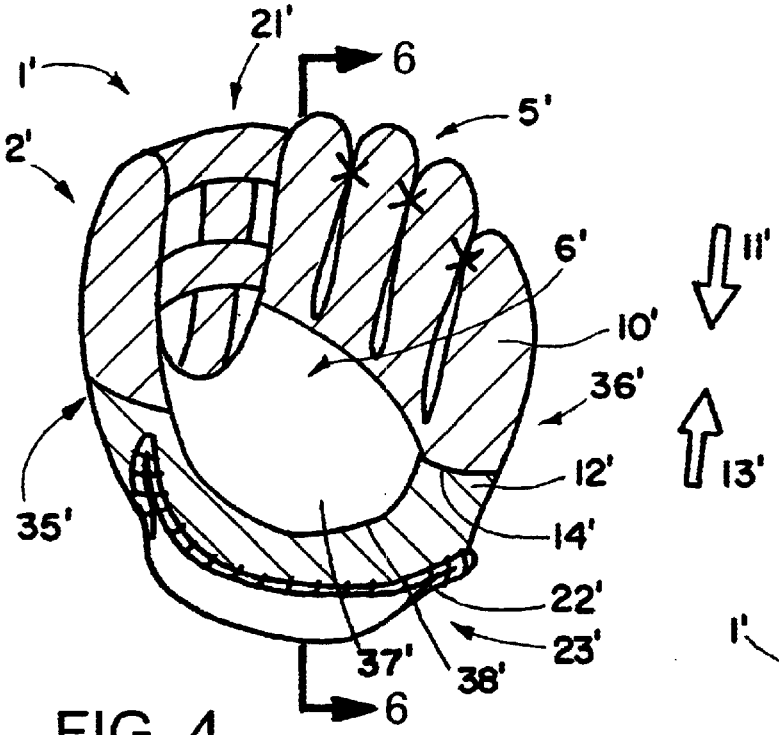
FIG. 4 is the front view of a glove according to another aspect of the invention.
Figure 5:
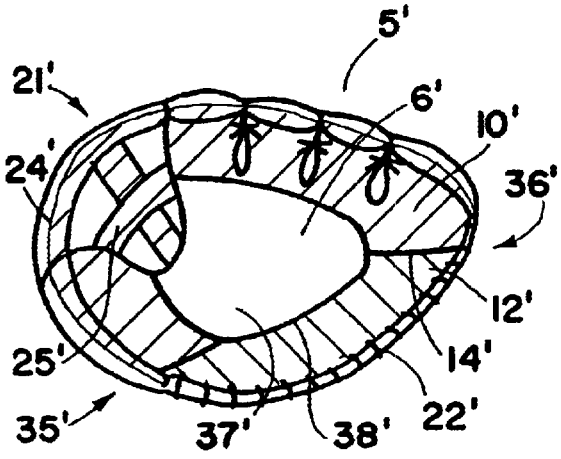
FIG. 5 is the top view of the glove of FIG. 4.
Figure 6:
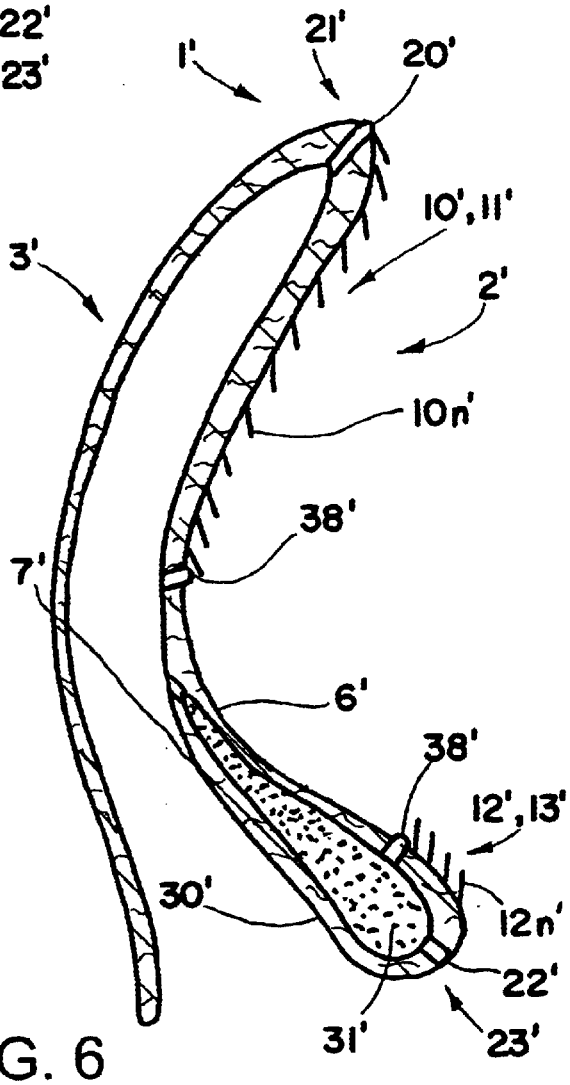
FIG. 6 is a sectional view of the glove taken along line 6—6 of FIG. 4.
Figure 7:
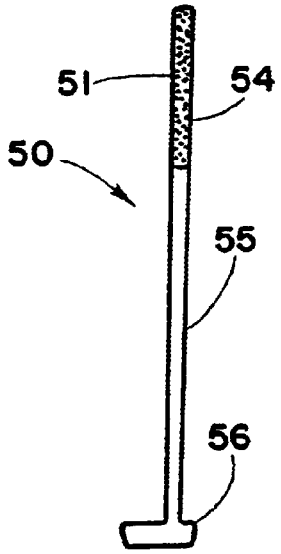
FIG. 7 is a schematic elevation view of a golf club having an elongate shaft with suede leather material at the handle end of the shaft.
Figure 8:
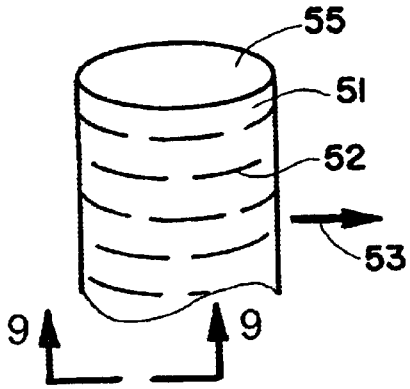
FIG. 8 is an enlarged fragmentary isometric view of the golf club shaft of FIG. 7 showing suede leather material thereon.
Figure 9:
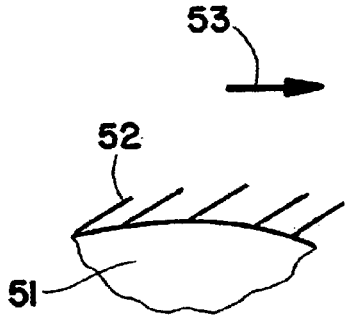
FIG. 9 is a fragmentary section view of the handle end of the golf club shaft looking generally in the direction of the arrows 9—9 of FIG. 8.

Referring now to FIGS. 4 through 6, another embodiment of a glove 1' is shown.

The suede leather material 10' with a smooth first direction 11' is oriented relative to the suede leather material 12' with a smooth direction 13' such that the respective naps **10*n*', 12*n*' of each material are oriented so that they are facing each other. This is done to facilitate and to enhance retention of a ball in the glove 1' as was described above with respect to the glove 1 of FIGS. 1–3. To that end, the nap 10*n*' of the suede leather material 10' is oriented in a generally downward direction 11'. The nap 12*n*' of the suede leather material 12' is oriented in a generally upward direction 13'. The suede leather material 10' is attached to the suede leather material 12' by a middle stitch line 14' near the respective sides 35', 36'** of the glove.

The front 2' of the glove 1' contains a ball pocket 6' approximately at the center of the glove 1'; and the leather material 37' of which the pocket 6' is made is attached to the suede leather material 10' by a middle stitch line 14' and by a bottom ball pocket stitch line 38' to the suede leather material 12'. The ball pocket 6' may be of smooth suede leather material or other leather material. Unlike the ball pocket 6', the other portions of the front 2' use suede leather material 10', 12' with a nap **10*n*', 12*n*' having smooth directions 11', 13'** and resistant direction facing opposite the smooth directions.

Because the suede leather material 10' has a nap **10*n*' which is oriented in a generally downward direction 11', a ball entering the top of the glove is directed into the ball pocket 6' and the rolling, sliding or popping of the ball out of the glove 1' is impeded. Similarly, a ball entering the bottom of the glove is directed to the ball pocket 6' by the upward direction 13' of the nap 12*n*' of the second suede leather material 12'**. If a ball enters the glove traveling in a direction with the nap of the suede leather material it will experience a lower frictional force than if it is traveling against the direction of the suede leather material. As a result, the retention of the ball is facilitated and enhanced in the glove by orienting the respective naps in their respective directions such that they face each other.

The front 2' and the back 3' are attached to each other by a top stitch line 20' at the top 21' of the glove 1' and by a hand opening stitch line 22 of the bottom 23' of the glove 1'. Both the front 2' and the back 3' include finger portion 5', including a thumb portion 24', and a web portion 25' generally as were described above with respect to the glove 1 of FIGS. 1–3.

Referring to FIG. 6, a sectional view of the glove 1' is shown according to section line 6—6 as shown in FIG. 4. FIG. 6 more clearly shows the opposing nap directions 11', 13' of the suede leather materials 10', 12'. FIG. 6 shows the inside front surface 30' which comes into contact with the wearer's palm and fingers when worn on the hand. The palm portion 7' may include a cushioning or shock absorbing material 31'. The shock absorbing material 31' is situated between the walls of the palm portion 7' and a combination of the wall created by the back of the first and second suede leather materials 10', 12'.

The glove 1' may be used in a manner similar to use of the glove 1 as was described above. Since the pocket 7' does not have a nap direction that affects ball movement, the pocket tends to be relatively neutral in retaining the ball therein, as a pocket usually does with the glove "closed," without tending to facilitate ball movement in one or another direction.

Figure 10:
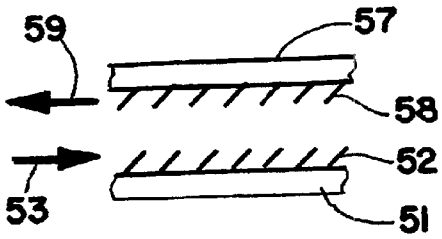
FIG. 10 is a fragmentary section view of the handle end of the golf club shaft with suede leather material as shown in FIG. 9 and additionally the relation thereof to a fragmentary illustration of suede leather material of a golf glove with the respective naps in opposing relation generally transverse to the shaft axis.

Turning briefly to FIGS. 7–10, an exemplary golf club 50 has a suede leather grip 51. The leather grip 51 has a nap 52 with a smooth direction 53. As is the usual case for golf clubs, the leather grip 50 is at the "handle" end 54 of the golf club shaft 55 remote from the golf club head 56. The nap smooth direction 53 is generally transverse (at least in a flattened "polar coordinates" relation) to the axial direction of the shaft 55. The nap smooth direction 53 is selected to coordinate with a golf glove, a fragmentary portion 57 of which is illustrated in FIG. 10, especially a golf glove that has a suede leather exterior that is intended to engage the handle end 54 of the golf club 50. In the illustrated example the golf glove suede leather material has a nap 58 with a smooth direction 59. The coordinated relation between the golf glove nap 58 and the suede leather grip nap 52 is such that the smooth directions 53, 59 thereof are, respectively, in the opposite directions during use together, as is illustrated schematically in FIG. 10. Such relationship helps resist rotational motion of the shaft 55 about its axis as it is held by a golfer and used to hit a golf ball. Such enhanced gripping of the club 50 may enhance the result as the golf club is used to hit golf balls.

It will be appreciated that the above description of the invention with respect to use with a golf club and associated glove also is applicable to other sports or other activities. For example, instead of use with a golf club, the invention may be used with a tennis racket, baseball bat (if the rules permit), hockey stick or the like.

Figure 11:
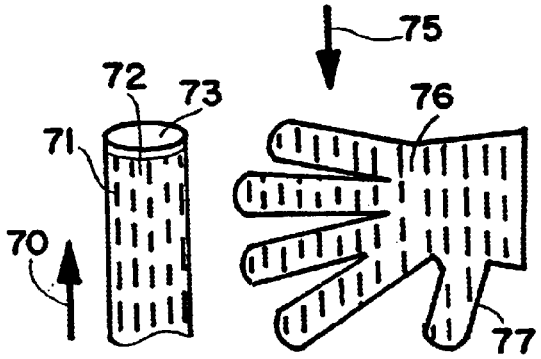
FIG. 11 is a schematic illustration of a shaft with suede leather material thereon and a glove with suede leather material thereon, the respective naps being in opposing relation in a direction generally parallel to the shaft axis.

Moreover, as is schematically illustrated in FIG. 11, the smooth direction 70 of the nap 71 of suede leather material 72 on a shaft 73, such as that of a hockey stick, baseball bat, golf club, or other shaft may be parallel to the axis of the shaft. The smooth direction 75 of the suede leather material 76 of the sports glove 77 may be coordinated to point generally opposite the smooth direction 70. With the smooth directions 70, 75 so coordinated relative to each other and to the shaft 73, the naps tend to help resist the shaft sliding out of the hand of the user, e.g., a golf club "flying" out of the hands of a golfer, a baseball bat "flying" out of the hands of a batter, etc.

Figure 12:
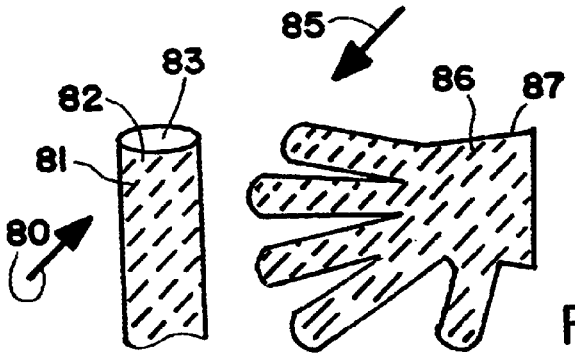
FIG. 12 is a schematic illustration of a shaft with suede leather material thereon and a glove with suede leather material thereon, the respective naps being in opposing relation in a direction generally oblique to the shaft axis.

As is schematically illustrated in FIG. 12, the smooth direction 80 of the nap 81 of suede leather material 82 on a shaft 83, such as that of a hockey stick, baseball bat, golf club, or other shaft may be oblique to the axis of the shaft. The smooth direction 85 of the suede leather material 86 of the sports glove 87 may be coordinated to point generally opposite the smooth direction 80. With the smooth directions 80, 85 so coordinated relative to each other and to the shaft 83, the naps tend to help resist the shaft rotating in the hand of the user and sliding out of the hand of the user as the shaft is swung or otherwise moved in usual directions while playing a sport, for example, manipulating a tool, such as a hammer, pick axe or the like, etc.

With respect to the several embodiments of the invention in which suede leather material having a nap is on a shaft of a sports object or some other object, tool, implement, etc., it will be appreciated that such shaft may have enhanced properties of resisting rotation or "flying" out of the hold of a user by virtue of the preferred nap direction coordinated with desired enhanced properties. Thus, such enhanced properties may be obtained without the use of a specially coordinated glove of suede leather material.

As was mentioned above, the invention may be used for gloves and, if desired, other objects, such as various types of shafts. Moreover, for use of the invention with both gloves and shafts, the smooth directions may be coordinated to obtain the features and functions described above.

Additionally, it will be appreciated that features of the invention may be obtained using material other than leather, provided the material has a nap or increased resistance or friction similar to that of suede leather material.

From the foregoing it will be appreciated that a glove in accordance with the present invention has enhanced retention capabilities relative to prior gloves. Moreover, a leather glove according to the invention meets with the requirements of the code of rules for baseball.

INDUSTRIAL APPLICABILITY

The invention may be used to enhance the gripping, retention and like capabilities of gloves.

I claim:

1. A baseball glove, comprising a finger portion, thumb portion, webbing between the finger and thumb portion, and a pocket, said finger portion including suede, said suede having a nap with a smooth direction leading toward the pocket and a rough direction resisting movement away from the pocket.

2. The baseball glove of claim 1, said pocket comprising suede leather material.

3. The baseball glove of claim 1, said pocket comprising leather material.

4. The baseball glove of claim 1, comprising a palm portion and a shock absorbing material; said palm portion being attached to the inside surface of said pocket; said shock absorbing material being situated between said palm portion and the inside surface of said pocket.

5. A method of making a glove, comprising attaching together a number of glove portions, at least one of which has a nap with a smooth direction and a braking direction, and orienting such nap as to provide a preferred smooth direction and a preferred braking direction that tends to resist sliding, rolling or other movement with respect thereto compared to the smooth direction, said attaching comprising attaching together at least two glove portions that have respective naps, and orienting the nap of one such glove portion to have a smooth direction that faces the smooth direction of the nap of another glove portion.

6. The method of claim 5, said glove portions comprising leather.

7. The method of claim 5, further comprising selecting said glove portions having nap as leather.

* * * * *